US005346100A

United States Patent [19]

Lay

[11] Patent Number: 5,346,100

[45] Date of Patent: Sep. 13, 1994

[54] TOGGLE-ACTION DISPENSING CLOSURE WITH AN ACTUATION-PREVENTION ABUTMENT AND A FRACTURE CONTROL SURFACE

[75] Inventor: Dieter Lay, Oconomowoc, Wis.

[73] Assignee: AptarGroup, Inc., Crystal Lake, Ill.

[21] Appl. No.: 182,292

[22] Filed: Jan. 14, 1994

[51] Int. Cl.[5] ..... B65D 47/00; B67D 5/32

[52] U.S. Cl. ..... 222/153; 222/536

[58] Field of Search ..... 222/153, 533, 534, 536, 222/556

[56] References Cited

U.S. PATENT DOCUMENTS

| | | | |
|---|---|---|---|
| 3,223,287 | 12/1965 | Sagarin | 222/153 |
| 3,318,494 | 5/1967 | Porter et al. | 222/534 |
| 3,568,895 | 3/1971 | Porter | 222/534 |
| 4,095,725 | 6/1978 | Goncalves | 222/153 |
| 4,452,364 | 6/1984 | Kay | 215/253 |
| 4,607,768 | 8/1986 | Taber et al. | 222/556 |
| 4,610,371 | 9/1986 | Karkiewicz | 220/266 |
| 4,711,372 | 12/1987 | Gach | 222/23 |
| 4,776,501 | 10/1988 | Ostrowsky | 222/536 X |
| 4,805,792 | 2/1989 | Lecinski, Jr. | 215/253 |
| 4,962,869 | 10/1990 | Gross et al. | 222/153 |
| 5,152,432 | 10/1992 | De Laforcade | 222/145 |
| 5,205,424 | 4/1993 | Gaspar | 222/153 X |
| 5,236,107 | 8/1993 | Spaanstra, Sr. | 222/536 X |
| 5,279,451 | 1/1994 | Mueller et al. | 222/534 X |
| 5,284,264 | 2/1994 | Gross | 222/153 X |

OTHER PUBLICATIONS

Pending U.S. Patent Application No. 169,514, of Dieter Lay and Entitled "Toggle-Action Dispensing Closure With Capture Structure For Severable Actuation-Prevention Abutment"filed on Dec. 17, 1993.

*Primary Examiner*—Kevin P. Shaver

*Attorney, Agent, or Firm*—Dressler, Goldsmith, Shore & Milnamow, Ltd.

[57] ABSTRACT

A toggle-action container dispensing closure is provided for manipulation between a closed, non-dispensing orientation and an open, dispensing orientation. The closure includes an actuator mounted on a body secured to the container. The body defines a shearing wall-receiving recess. The body has a rear surface spaced from the abutment. The rear surface defines the rear of the recess. The body also has a control surface defining the bottom of the recess at the base of the abutment. The control surface extends from the rear surface to the abutment. This controls the fracture of the abutment from the control surface through the abutment.

10 Claims, 2 Drawing Sheets

TOGGLE-ACTION DISPENSING CLOSURE WITH AN ACTUATION-PREVENTION ABUTMENT AND A FRACTURE CONTROL SURFACE

TECHNICAL FIELD

This invention relates to a container toggle-action dispensing closure which can be manipulated between a closed orientation and an open, dispensing orientation.

BACKGROUND OF THE INVENTION AND TECHNICAL PROBLEMS POSED BY THE PRIOR ART

Designs have been proposed for containers used with flowable substances wherein a closure is provided for being attached to the container mouth and wherein the closure includes a toggle-action actuator, flip-up spout, or nozzle assembly for dispensing the container contents. See, for example, U.S. Pat. Nos. 5,058,775, 4,962,869, 4,776,501, 4,645,086 and 3,516,581.

The toggle-action closures, such as those disclosed in the above-referenced U.S. Pat. Nos. 5,058,775, 4,962,869, and 4,776,501, require that the operator push down on a top, rear portion of the closure in order to pivot the actuator of the closure to the dispensing orientation.

When the actuator is pivoted to the dispensing position, a discharge passage in the actuator is in communication with the container contents, and the container contents can flow out through the actuator. Typically, such toggle-action closures are provided on squeezable containers fabricated from a thermoplastic material providing a inwardly deformable, resilient wall structure. When the container wall structure is squeezed, the contents within the container are forced upwardly and out through the open dispensing closure.

During shipping and handling, a toggle-action closure may be accidentally bumped or impacted in a way that causes the closure to pivot to the dispensing orientation. It is then possible for the contents to be discharged. If the container is lying on its side, the contents can leak out of the accidentally opened closure. If the container is in a carton, the carton may be subjected to rough handling causing the wall of the container to be temporarily squeezed inwardly and causing an unwanted discharge of a portion of the container contents through the open closure.

In order to prevent or substantially minimize the potential for leakage or spillage of container contents during shipping and handling of containers provided with toggle-action closures, the closure of the type disclosed in the above-referenced U.S. Pat. No. 4,962,869 was developed. This closure has effectively solved a long-felt need to prevent inadvertent discharge through toggle-action closures during shipping and handling.

The closure disclosed in the U.S. Pat. No. 4,962,869 provides a unique structure which prevents or greatly inhibits the opening of the toggle-action actuator during shipping and handling. In particular, the closure body is provided with an upstanding abutment or resistance post under a rear portion of the toggle-action actuator. The actuator includes a shearing wall for confronting the abutment post when the actuator is initially closed in the non-dispensing position. When a moderate force is applied to the rear of the actuator, the actuator will not tilt upwardly to the open position because the shearing wall engages the abutment.

The abutment is designed to withstand the forces typically encountered during shipping and handling. However, the abutment is designed to be sheared off when the actuator is subjected to at least a predetermined force greater than the forces typically encountered during shipping and handling. When the consumer uses the closure for the first time, the consumer must apply, to the rear of the actuator, a force at least equal to the predetermined force so as to cause the shearing wall to shear off the abutment. Thereafter, the consumer can subsequently open the actuator by applying a much lower force.

The above-discussed design disclosed in the U.S. Pat. No. 4,962,869 functions very well and satisfies the objectives of preventing or inhibiting leakage during shipping and handling. However, the precise magnitude of the force required to shear off the abutment is not easily determinable, and the required shear force may vary somewhat from closure to closure. It would be desirable to provide an improved design in which the required shear force could be more predictable and controllable.

It would be also desirable to provide an improved dispensing closure with an actuation-prevention abutment that could be molded from thermoplastic material in a mold assembly that is less fragile and that is subject to less manufacturing variation.

The present invention provides an improved closure which can accommodate designs having the above-discussed benefits and features.

SUMMARY OF THE INVENTION

The toggle-action dispensing closure of the present invention is adapted to be mounted over the opening in a container, especially a container of the type having a generally flexible wall portion which can be squeezed to assist in dispensing the contents from the container.

The closure includes a severable abutment for preventing, or reducing the likelihood of, an inadvertent, premature opening or actuation of the closure to the dispensing position during shipping and handling.

When the closure is first used by the consumer, the abutment is sheared off. The closure components can be relatively easily manufactured and readily assembled.

The closure includes a body for engaging the container over the opening to the container. The body defines a discharge aperture communicating with the container opening.

An actuator is pivotally mounted on the body for occluding flow from the container through the discharge aperture when the actuator is in a closed, non-dispensing position. The actuator permits flow from the container when force is applied to the actuator to tilt the actuator to an open, dispensing position.

The body has a severable abutment under the actuator. The actuator has a shearing wall for confronting the abutment when the actuator is in the non-dispensing position. This prevents the tilting of the actuator to the dispensing position in response to the actuator being subjected to a force less than a predetermined force. However, the shearing wall shears the abutment from the body when the actuator is subjected to at least the predetermined force so that, thereafter, the actuator can be tilted to the dispensing position in response to the application of a force less than the predetermined force.

In order to control the manner in which, and the force at which, the abutment is sheared off, the body defines a shearing wall-receiving recess. The body has a rear surface spaced from the abutment. The rear surface defines the rear of the recess. The body also has a control surface defining the bottom of the recess at the base of the abutment. The control surface extends from the rear surface to the abutment. This has been found to control the fracture of the abutment from the control surface through the abutment. With this surface, the fracture is more likely to occur within a predetermined narrow range of forces applied to the actuator.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the closure of this invention is described in an upright position, and terms such as upper, lower, horizontal, etc., are used with reference to this position. It will be understood, however, that the closure of this invention may be manufactured, stored, transported, used, and sold in an orientation other than the position described.

Figure 1:
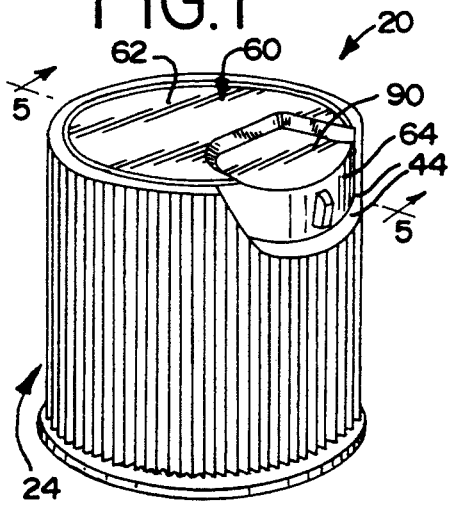
FIG. 1 is a perspective view of the closure of the present invention shown in a non-dispensing, closed orientation.

FIG. 1 shows an embodiment of the dispensing closure of the present invention in the closed, non-dispensing position wherein the closure is represented generally by reference numeral 20. The closure 20 is adapted to be mounted on a container (not illustrated) which may have a conventional open mouth defined by a neck (not illustrated) or other suitable structure. The container most typically is of the type having a generally flexible wall portion which can be squeezed to assist in dispensing the contents from the container.

The closure 20 includes a closure base or body 24 (FIGS. 3 and 4) for securement to the container. As seen in FIG. 4, the body 24 includes a generally cylindrical, upper wall 26 and a generally cylindrical, lower wall 27. A generally transverse closure wall or deck 28 (FIGS. 3, 4, 8, and 9) extends across the body 24 between the upper wall 26 and lower wall 27.

Figure 8:
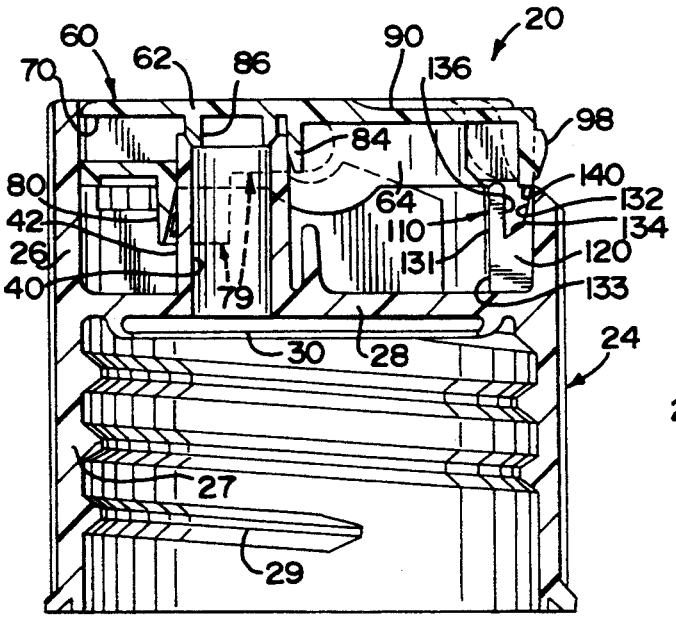
FIG. 8 is an enlarged, cross-sectional view taken generally along the plan 5—5 in FIG. 1.

The lower, cylindrical wall 27 of the closure body 24 is adapted to engage the outer periphery of the top of the container neck (not illustrated) around the container mouth, as with threads 29 (FIGS. 4 and 8). Other suitable engaging means (e.g., snap-fit beads) may be provided to secure the closure body 24 on the container. Alternatively, in some applications the closure body 24 could be non-releasably attached to, or formed unitary with, the container.

Figure 9:
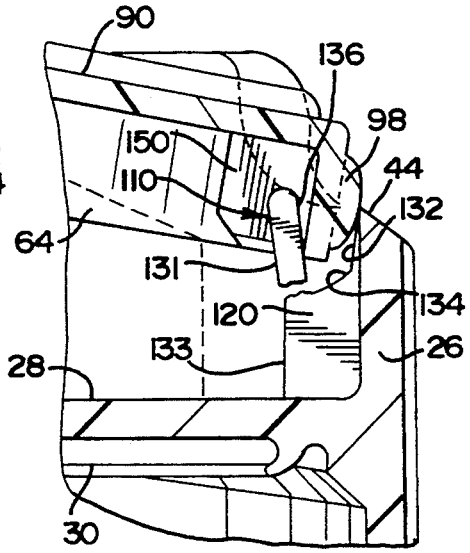
FIG. 9 is an enlarged, fragmentary view similar to FIG. 8 showing the actuator moving toward the full open position.

An annular sealing ring 30 may be provided as shown in FIGS. 4, 8, and 9 for engaging an interior edge of the container neck at the container mouth to effect a tight seal.

Figure 3:
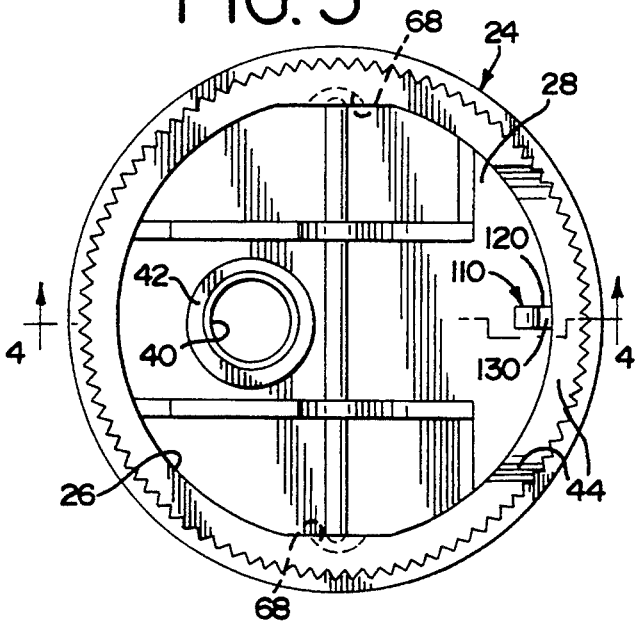
FIG. 3 is an enlarged, plan view of the closure with the actuator removed to reveal interior details of the body.
Figure 4:
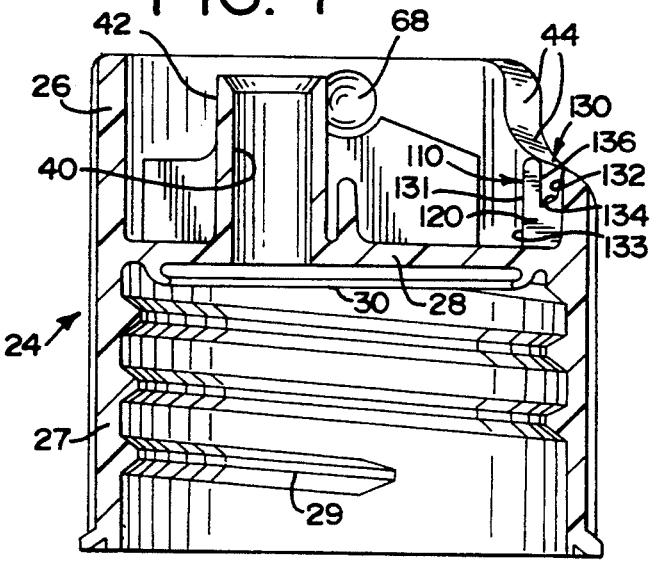
FIG. 4 is a greatly enlarged, cross-sectional view taken generally along the plane 4—4 in FIG. 3.

The closure body 24 includes a discharge aperture or passage 40 through the deck 28 as best illustrated in FIGS. 3, 4, and 8. In the preferred embodiment, the closure body 24 includes a discharge tube 42 projecting upwardly from the deck 28, and the discharge aperture 40 is defined within, and through, the tube 42. The discharge aperture 40 in the tube 42 communicates through the deck 28 with the container interior at the lower end of the tube 42.

As shown in FIGS. 3, 4, 8, and 9, the cylindrical, upper wall 26 of the closure body 24 extends upwardly above, and around, the closure body deck 28. A rear portion of the wall 26 above the deck 28 defines a fingerwell or finger recess area 44 in the form of a cutout or notch in the top edge of the wall 26.

Figure 5:
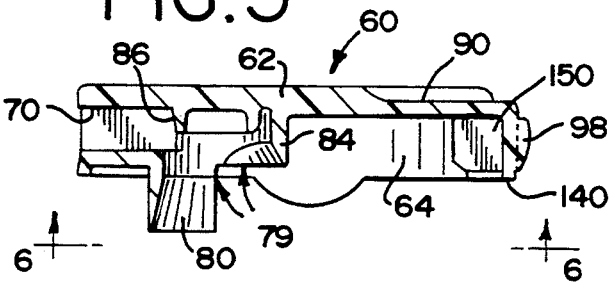
FIG. 5 is an enlarged, cross-sectional view of the actuator taken generally along the plane 5—5 in FIG. 1 with the body omitted for ease of illustration.
Figure 6:
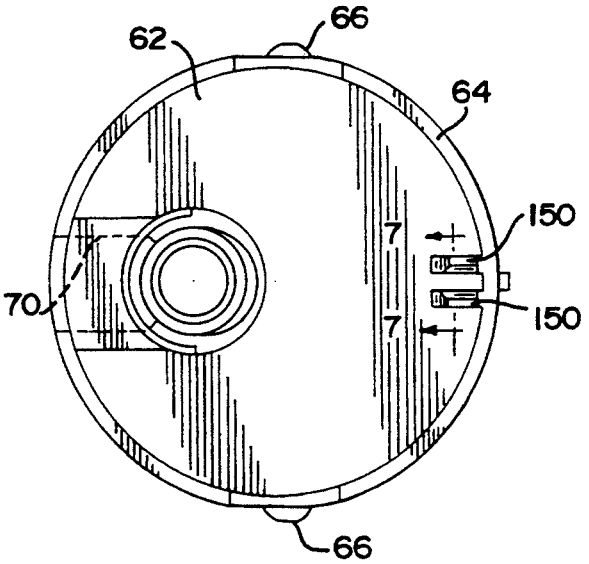
FIG. 6 is a bottom plan view of the actuator taken generally along the plane 6—6 in FIG. 5.

The closure body 24 receives a generally disc-like nozzle assembly, actuator means, or actuator 60. The actuator 60 includes a transverse top wall 62 and a peripheral flange 64 (FIGS. 1, 2, 5, 6, 8, and 9). At each of two diametrically opposed portions of the flange 64 there is a projecting, hemispherical protuberance or pivot member 66 with a flattened face (FIGS. 4, 6, and 8).

The pivot members 66 cooperate with the closure body upper wall 26 to mount the actuator 60 for pivoting movement within the closure body 24. To this end, the inner surface of the closure body wall 26 defines two hemispherical recesses 68 (FIGS. 3 and 4) for each mating with one of the pivot members 66 to provide a snap-action engagement of the pivot member 66. This accommodates the pivoting movement of the actuator 60 about a pivot axis defined by the pivot members 66 and receiving recesses 68.

Figure 2:
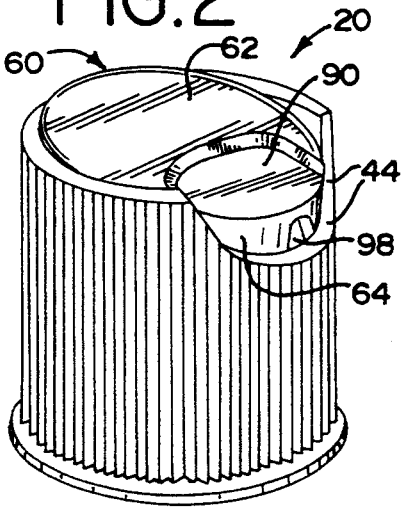
FIG. 2 is a perspective view of the closure shown in an open, dispensing orientation.

The top edge of the wall 26, above each recess 68, may be provided with a chamfer (not shown) for facilitating assembly. When the body 24 and actuator 60 are assembled, the actuator pivot members 66 and body recesses 68 function as mounting means so that the actuator 60 can be pivoted (by pushing downwardly on the rear portion of the actuator 60) until the forward end is exposed above the closure body wall 26 as illustrated in FIG. 2.

The actuator 60 includes a structure on the bottom surface of the top wall 62 which functions —depending upon the orientation of the actuator 60 —to either permit dispensing of flowable material from the body discharge tube 42 or occlude the tube passage 40 so as to prevent flow out of the discharge tube 42. In particular, as shown in FIGS. 5, 6, and 8, the actuator 60 includes a forwardly extending nozzle or channel 70 which merges with, and opens into, a stepped, cylindrical sealing wall 79.

The wall 79 surrounds and seals the upper periphery of the discharge tube 42 when the actuator 60 is in the closed position as illustrated in FIG. 8. In particular, the wall 79 forms a seal around the outer periphery of the discharge tube 42 as indicated by reference number 80 (FIGS. 5 and 8) at the front of the tube 42 and as indicated by the reference numeral 84 at the rear of the tube 42.

Preferably, a sealing plug 86 projects downwardly from the bottom of the actuator top wall 62. The sealing plug 86 has a generally cylindrical or annular configuration and is adapted to enter into the opening at the top of the discharge tube 42 to sealingly occlude the discharge aperture 40 in the tube 42 when the actuator is in the closed position as illustrated in FIG. 8.

On the other hand, when the rear of the actuator 60 is pushed down to tilt the actuator to the dispensing position as illustrated in FIG. 2, then the front portion of the sealing plug 86 is tilted away from the top of the discharge tube 42 to permit flow of the material out of the discharge aperture in the tube 42 and through the dispensing nozzle 70. When the actuator 60 is tilted to the dispensing position as illustrated in FIG. 2, the wall 79 (FIG. 5) still continues to seal the outer periphery of the upper end of the discharge tube 42 so that the container contents, while being dispensed into the nozzle 70, cannot leak out around the top of the discharge tube 42.

The actuator 60 can be pivoted to the open position by applying a downwardly directed force at a location on the top of the actuator 60. To this end, a rear portion of the actuator top wall 62 is recessed within a concave surface or finger well 90 (FIGS. 1, 2, and 4) for receiving the end of a thumb or finger.

An angled cam 98 (FIGS. 5 and 9) projects rearwardly from the outer, vertical surface of the actuator flange 64 at the rear of the actuator 60. As illustrated in FIGS. 2, 3, 4, 8, and 9, the closure body cylindrical, upper wall 26 defines surface which is radially aligned with the cam 98 on the back of the actuator 60. When the actuator 60 is tilted to the dispensing position (FIG. 2), the most rearwardly extending portion of the cam 98 frictionally engages the wall 26. The cam 98 thus serves to stabilize the actuator 60 as it is being pivoted, and the cam 98 provides a frictional engagement to maintain the actuator in the tilted, open position. The actuator 60 can be returned to the closed position by pushing down on the front part of the actuator.

In accordance with the present invention, a permanently deformable and severable resistance means or abutment, such as a post 110, is provided to prevent accidental movement of the actuator 60 to the open, dispensing orientation. This provides a closure which is resistant to inadvertent actuation during shipping and handling prior to use by a consumer.

The abutment or post 110 is located at the rear of the closure and projects upwardly from the body deck 28. The post 110 is included as part of an upstanding wall 120. The post 110, in the illustrated preferred embodiment, has a generally rectangular transverse cross section, four planar sides, and a semicylindrical top.

The abutment or post 110 has a front surface 131 facing inwardly toward the center of the closure. The front surface 131 extends upwardly from a front face 133 of the wall 120 in the same plane as the front face.

On the opposite side of the abutment or post 110, the abutment or post 110 is separated by a notch or recess 130 from an adjacent portion of the wall 120 or body wall 26. One side of the post 110 faces rearwardly and is defined by a generally planar, engaging surface 136. The surface 136 defines a front portion of the recess 130.

The rear portion of the recess 130 is defined by a rear surface 132 which extends downwardly from the top edge of the finger area 44 in the body wall 26. The rear surface 132 may be oriented at an angle relative to the longitudinal axis of the closure, a preferred angle being between about one degree and about ten degrees.

The bottom of the recess 130 is defined by a fracture control surface 134. The surface 134 extends from the bottom of the rear surface 132 to the abutment engaging surface 136 at the bottom of the abutment. The fracture control surface 136 is oriented at an angle which is less steep than the angle at which the rear surface 132 is oriented. In the preferred embodiment, the angle of the fracture control surface 134 is about 60 degrees relative to the longitudinal axis of the closure. In the preferred embodiment wherein the abutment post 110 has an engaging surface 136 which is oriented parallel to the longitudinal axis of the closure, the angle defined between the engaging surface 136 and the fracture control surface 134 is about 60 degrees.

The recess 130 is sufficiently wide, at least at the top of the recess, to accommodate the bottom edge of the actuator flange 64 when the actuator is pressed down. The bottom edge of the actuator flange 64 can then enter the recess 130 and contact the engaging surface 136 of the abutment post 110.

More specifically, the recess 130 in the wall 120 lies under a shear wall or shearing wall 140 which is defined by the rear portion of the actuator peripheral flange 64. When a force is applied to the top, rear portion of the actuator 60, the shear wall 140 moves partway down into the recess 130 and then engages the surface 136 of the abutment 110.

The forces to which the actuator 60 may be subjected during shipping and handling are typically insufficient to deform or shear the abutment 110. Thus, the actuator 60 cannot be tilted to any significant extent away from the closed, non-dispensing position when the actuator is subjected only to such forces. Further, the closure body wall 26 acts resiliently upon the angled surface of the actuator cam 98 to urge the cam 98 upwardly, and hence the actuator back to the closed, non-dispensing position.

However, when a consumer subsequently wishes to use the closure, the consumer initially applies a substantially greater force to the finger well 90. A force equal to, or greater than, a predetermined force will drive the shear wall 140 against the abutment 110 with a force sufficient to sever the abutment 110 from the wall 120.

The abutment 110 is severed as a result of a fracture which is initiated at the convergence of the angled control surface 134 with the engaging surface 136 of the abutment 110. This defines a stress riser, and the fracture begins along the convergence of the two surfaces and then propagates through the cross-section of the abutment. The fracture tends to be directed along a path which is a continuation of the angled control surface 134. However, it has been found that the fracture, in many cases, extends in a somewhat uneven manner at an angle that may be less than the angle of the control surface 134. That is, with reference to FIG. 9, the angle of the fracture surface may be closer to a horizontal orientation.

In any event, it has been discovered that the fracture tends to occur within a much more narrow range of forces applied to the top of the actuator 60 compared with a prior design which is disclosed in the U.S. Pat. No. 4,962,869 and which does not have a control surface 134. That is, with the control surface design in accordance with the present invention, the abutment 110 will fracture within a relatively narrow range of actuation forces which can be more accurately predicted. The narrow range of actuation forces is substantially the same for each closure manufactured in accordance with the design. In contrast, the posts in closures disclosed in the U.S. Pat. No. 4,962,869 tend to fracture in a more random manner over a wider range of forces applied to the actuators.

It has also been found that the recess 130 provides another operational improvement. Comparison of the wall 120 and recess 130 with the structure disclosed in the above-discussed prior art U.S. Pat. No. 4,962,869 reveals that the recess 130 eliminates a greater portion of the wall 120. This results in a less rigid configuration with respect to the closure body cylindrical wall 26. Thus, when the rear of the actuator 60 is pushed down, the cam 98 more easily deflects the top edge of the wall 26 outwardly (at the recess 44) to accommodate the depressed position of the actuator 60 as it pivots open. Hence, after the abutment 110 has been sheared off, subsequent openings of the actuator 60 can be achieved with even less force than would otherwise be required.

While the present invention design contributes to a more reliable operation and has preferred operating characteristics, the design also facilitates manufacture of the closure. In particular, because the bottom of the recess 130 is defined by the control surface 134, the bottom region of the recess 130 has a blunt, and thicker, configuration (compared with the sharp angled recess configuration disclosed in the U.S. Pat. No. 4,962,869). Thus the mold steel which forms the recess 130 can be made thicker and less fragile. Further, the thicker mold steel can accommodate manufacturing variations more readily. This results in a more predictable and controllable molding operation and product. That in turn provides a more predictable and controllable product operation with respect to the fracturing of the abutment post 110.

In the preferred embodiment of the closure as illustrated, the abutment 110 does not fall onto the closure body deck 28 when the abutment 110 is sheared off. Rather, the sheared off abutment 110 is retained within the actuator by a retention structure.

Figure 7:
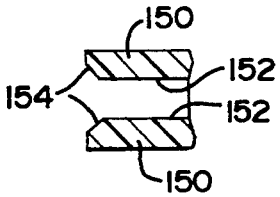
FIG. 7 is a greatly enlarged, fragmentary, partial, cross-sectional view taken generally along the plane 7—7 in FIG. 6.

Specifically, the rear portion of the actuator includes a pair of spaced-apart retaining walls 150 (FIGS. 6 and 7). Each wall defines a retaining surface 152 (FIG. 7 only) for sliding into engagement with the abutment 110 when the rear portion of the actuator 60 is tilted downwardly toward the closure body deck 28 (as shown in FIG. 9). The retaining walls 150 are spaced apart by an amount which is slightly less than the width of the abutment 110. The walls 150 are somewhat resilient so as to accommodate the movement of the walls down around the abutment 110. To this end, the rear, vertical side of each wall 150 is preferably spaced about 0.020 inches from the actuator flange 64.

The bottom portion or edge of each wall defines an angled surface 154 (FIG. 7). The angled surfaces 154 accommodate the initial movement of the walls 150 so that the abutment 110 is properly guided into, and received between, the walls 150. In a preferred embodiment, each surface 154 is angled at about 45 degrees relative to the adjacent vertical wall surface.

As the rear portion of the actuator 60 is tilted downwardly (FIG. 9), the retaining walls 150 deform as necessary to permit the continued reception of the abutment 110 deeper into the space between the walls 150. Eventually, the shearing wall 140 has moved an amount that is sufficient to completely sever (e.g., cut, break, tear, etc.) the abutment 110 completely from the wall 120. The sheared off abutment 110 remains tightly trapped between the spaced-apart walls 150 in the actuator 60. Thus, the sheared off abutment 110 cannot rattle around within the closure.

The above-described retention structure, which includes the walls 150, can be readily molded in the closure actuator. However, if desired, the retention structure can be eliminated altogether.

Once the abutment 110 has been sheared off, the actuator can be subsequently closed and then reopened as necessary. The subsequent reopening of the actuator requires considerably less force than is required to initially shear off the abutment 110. The force required for subsequent actuation need only be great enough to overcome the friction and interfering engagement between the actuator cam 98 and the body wall 26 (as well as any other snap fit interference features that may be employed to provide a small retention force on the actuator in the closed position).

The closure of the present invention can be readily molded from thermoplastic materials and easily assembled to provide a stream-lined product. The closure provides a desirable toggle-action dispensing operation.

It will be readily apparent from the foregoing detailed description of the invention and from the illustrations thereof that numerous variations and modifications may be effected without departing from the true spirit and scope of the novel concepts or principles of this invention.

What is claimed is:

1. In a toggle-action dispensing closure for an opening to a container wherein said closure includes:

a body for engaging said container over said opening and defining a discharge aperture communicating with said opening; and an actuator pivotally mounted on said body for occluding flow from said container through said discharge aperture when said actuator means is in a closed non-dispensing position and for permitting flow from said container when force is applied to said actuator to tilt said actuator to an open dispensing position, said body having a severable abutment under said actuator, and said actuator having a shearing wall for confronting said abutment when said actuator is in said non-dispensing position to prevent tilting of said actuator to said dispensing position in response to said actuator being subjected to a force less than a predetermined force, but said shearing wall shearing said abutment from said body when said actuator is subjected to at least said predetermined force so that thereafter said actuator can be tilted to said dispensing position in response to the application of force less than said predetermined force, the improvement comprising:

said body defining a receiving space behind said abutment for receiving said shearing wall, said body having:

(1) a rear surface spaced from said abutment and defining the rear of said recess and (2) a fracture control surface defining the bottom of said recess, said control surface extending from said rear surface to said abutment.

2. The closure in accordance with claim 1 in which said abutment is a post that includes a planar engaging surface defining one side of said recess and facing said rear surface; and said control surface extends between said engaging surface and said rear surface to define an angle of about 60 degrees between said engaging surface and said control surface.

3. The closure in accordance with claim 1 in which said control surface is planar.

4. The closure in accordance with claim 1 in which said rear surface is planar.

5. The closure in accordance with claim 2 in which said engaging surface is planar.

6. The closure in accordance with claim 1 in which said body has a transverse deck; and said abutment extends upwardly from said deck

7. In a toggle-action dispensing closure for an opening to a container wherein said closure includes:

a body for engaging said container over said opening and defining a discharge aperture communicating with said opening; and an actuator pivotally mounted on said body for occluding flow from said container through said discharge aperture when said actuator is in a closed non-dispensing position and for permitting flow from said container when force is applied to said actuator to tilt said actuator to an open dispensing position, said body having a severable abutment under said actuator but disengaged from said actuator when said actuator is in said non-dispensing position, and said actuator having a shearing wall located adjacent the periphery of the actuator for confronting said abutment when said actuator is in said non-dispensing position to prevent tilting of said actuator to said dispensing position in response to said actuator being subjected to a force less than a predetermined force, but said shearing wall shearing said abutment from said body when said actuator is subjected to at least said predetermined force so that thereafter said actuator can be tilted to said dispensing position in response to the application of force less than said predetermined force, the improvement comprising:

said abutment having an engaging surface for being engaged by said actuator shearing wall;

said body defining a rear surface that is spaced from engaging surface; and said body defining a fracture control surface extending between said rear surface and said engaging surface.

8. The closure in accordance with claim 7 in which said rear surface and control surface are planar and are inclined relative to said abutment surface.

9. The closure in accordance with claim 8 in which said rear surface is inclined more steeply than said control surface.

10. The closure in accordance with claim 7 in which said abutment projects upwardly from a wall having a planar front face extending below said abutment;

said abutment has a front surface facing in a direction opposite to the direction in which said engaging surface faces; and said front surface of said abutment extends upwardly from said wall front face in the same plane as said front face.

* * * * *